United States Patent [19]

Leibrock et al.

[11] 4,128,402

[45] * Dec. 5, 1978

[54] APPARATUS FOR COMPACTING COAL

[75] Inventors: Kurt Leibrock; Adolf Bier, both of Völklingen; Friedrich Büch, Walpershofen, all of Fed. Rep. of Germany

[73] Assignee: Saarbergwerke Aktiengesellschaft, Saarbrueken, Fed. Rep. of Germany

[ * ] Notice: The portion of the term of this patent subsequent to Aug. 22, 1995, has been disclaimed.

[21] Appl. No.: 790,617

[22] Filed: Apr. 25, 1977

[30] Foreign Application Priority Data

Apr. 27, 1976 [DE] Fed. Rep. of Germany ..... 2618327

[51] Int. Cl.[2] ..... B30B 11/00; C10L 5/22

[52] U.S. Cl. ..... 44/11; 44/2; 44/13; 100/209

[58] Field of Search ..... 44/2, 11–13, 44/10 D, 10 E, 10 G; 75/42; 100/209, 218, 237

[56] References Cited

U.S. PATENT DOCUMENTS 3,070,485 12/1962 Strickman ..... 44/13 X

FOREIGN PATENT DOCUMENTS 47-6215 2/1972 Japan ..... 44/13

*Primary Examiner*—Carl Dees

*Attorney, Agent, or Firm*—Michael J. Striker

[57] ABSTRACT

An apparatus for compacting coal in a pounding box to convert it into a cake usable in coke ovens has one or more punners which are each composed of an upright the lower end of which carries a pounding foot. At opposite sides of the respective upright are arranged a pair of engaging elements which are made to engage the upright and are then moved to an upper position, during which movement they take along the upright to raise the pounding foot above the coal in the pounding box. On reaching their upper position the engaging elements release the upright so that the punner can drop by gravity onto the coal in the box.

20 Claims, 5 Drawing Figures

APPARATUS FOR COMPACTING COAL

BACKGROUND OF THE INVENTION

This invention relates to an apparatus for compacting coal in a pounding box by alternately raising and releasing punners so that they can drop onto the coal and compact it into a cake for use in coking ovens.

More particularly, the invention relates, in an apparatus of this type, to the means for raising the punners.

Certain types of hard coal are suited for coking operations only if the coal has first been compacted to form a coke which is then inserted into the coking oven. The compacting is carried out in a pounding box into which a quantity of coal is admitted. To obtain economical operation, it is necessary that compacting of the coal charge in the pounding box be effected as rapidly as possible; at the same time, however, the compaction must be as effective and as uniform as possible throughout the entire volume of the pounding box.

Compacting is carried out by punners which are each composed of an upright carrying a foot at its lower end. The punners are raised and then released to drop onto the coal under the influence of gravity. To obtain the desired results each punner must perform a large number of drops per unit time; it must also be raised as high as possible to obtain sufficient impact and it must be raised to substantially the same height every time.

Once the coal has been sufficiently compacted to form a cake, the punners must be retained in their raised position so as to disengage their feet from the cake, in order to permit the cake to be pushed into the coking oven.

The prior-art constructions are not fully satisfactory in connection with these operations. They do not raise the punners uniformly or to sufficient heights and may, over a period of time, even undergo sufficient wear so that they do not raise the punners at all. Moreover, they use rotating discs which are to raise the punners and which produce highly objectionable noise levels when the equipment is in operation.

When the compaction process is finished, the punners of the prior-art equipment are maintained in raised positions by manually hammering-in wedges which engage the uprights and hold them in upper positions. This is time-consuming and ultimately damages the uprights where they are engaged by the wedges. Moreover, this method is not reliable because the wedges frequently work loose — or are not applied sufficiently strongly to hold the punners in place.

SUMMARY OF THE INVENTION

It is an object of the present invention to overcome the disadvantages of the prior art.

A more particular object is to provide an apparatus of the kind under discussion, which avoids the prior-art drawbacks.

Another object is to provide such an apparatus which is much quieter in operation than the known ones.

Still a further object is to provide such an apparatus wherein the punners are always raised to the same height, i.e., not to heights which vary.

A concomitant object is to provide an apparatus of the type in question wherein the punners can be retained in their upper position without requiring either manual operations or the use of wedges.

An additional object is to assure that the punners per se, and the apparatus overall, are subjected to as little mechanical stress as possible.

Yet a further object is to provide such an apparatus which is relatively simple and hence reliable and inexpensive.

In keeping with these objects, and with others which will become apparent hereafter, one feature of the invention resides, in an apparatus for compacting coal in a pounding box to convert the coal into a cake usable in coke ovens by repeatedly lifting and dropping onto the coal at least one punner composed of an upright and a foot at a lower end of the same in a combination comprising engaging means for frictionally engaging the upright; mounting means mounting the engaging means for displacement in a path between a lower position in which it engages and entrains the upright and an upper position in which it releases the upright and permits dropping of the punner onto the coal; drive means for moving the engaging means between the positions thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
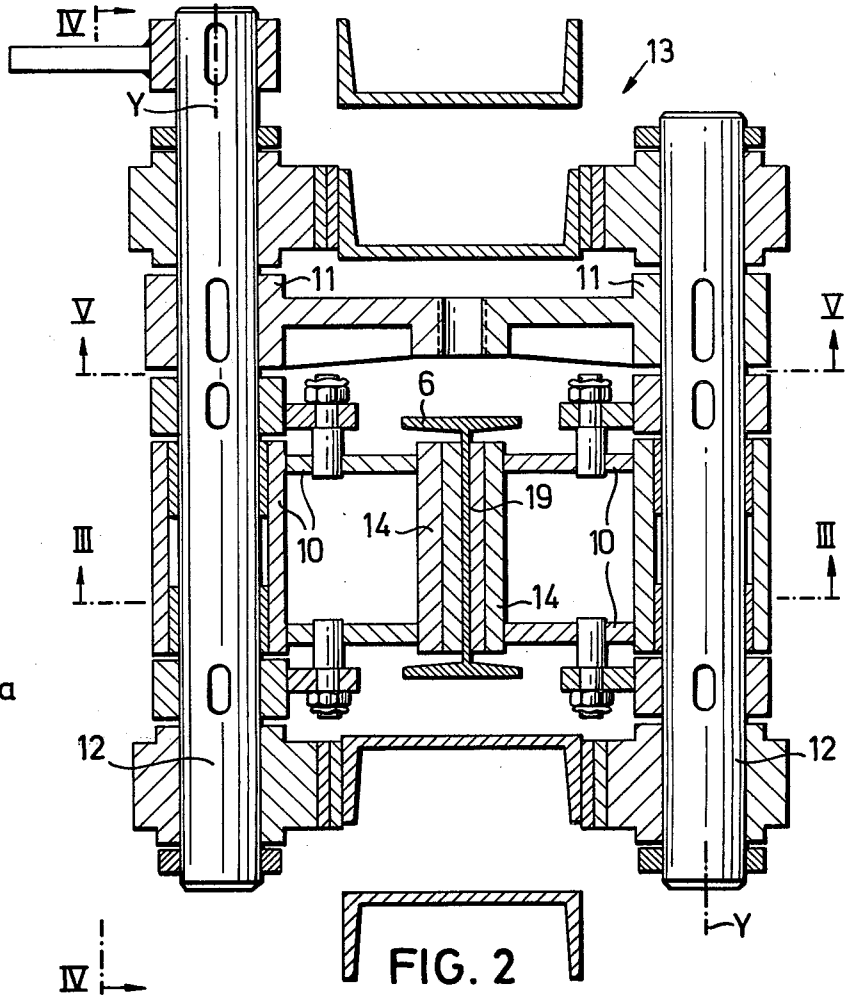
FIG. 2 is a section taken on line II—II of FIG. 1.

A single, examplary embodiment of the invention is illustrated in FIGS. 1-5. The pounding box 3 and its coal charge 2 which is to be converted into a cake or slab to be fed into a coking oven, are shown only diagrammatically.

Positioned above the pounding box 3, and supported on a not-illustrated support (e.g., framework) is an apparatus 1 for compacting the coal 2. This apparatus may comprise several (e.g. 4) carriages 4 of which only one is shown; the carriages are connected so as to move as a unit on rails (not shown) in longitudinal direction of the pounding box 3 (i.e., left to right and vice versa in FIG. 1); a cylinder-and-piston unit (not shown) may move the carriages.

The carriages 4 are identical; hence, the description and illustration of only one of them will suffice as being representative of the others. This illustrated carriage 4 has four geometrically identical rams 5 (known as punners) each of which is composed of an upright of H-shaped cross-section and a coal-engaging pounding foot 6*a*. However, a lesser or greater number (e.g., six) of punners 5 can be provided per carriage.

The punners are guided by guide rolls 7 and beams 7*a*, so that they can be alternately raised and then allowed to drop onto the coal 2. At the same time the carriages 4 are moved lengthwise of the pounding box 3.

Figure 1:
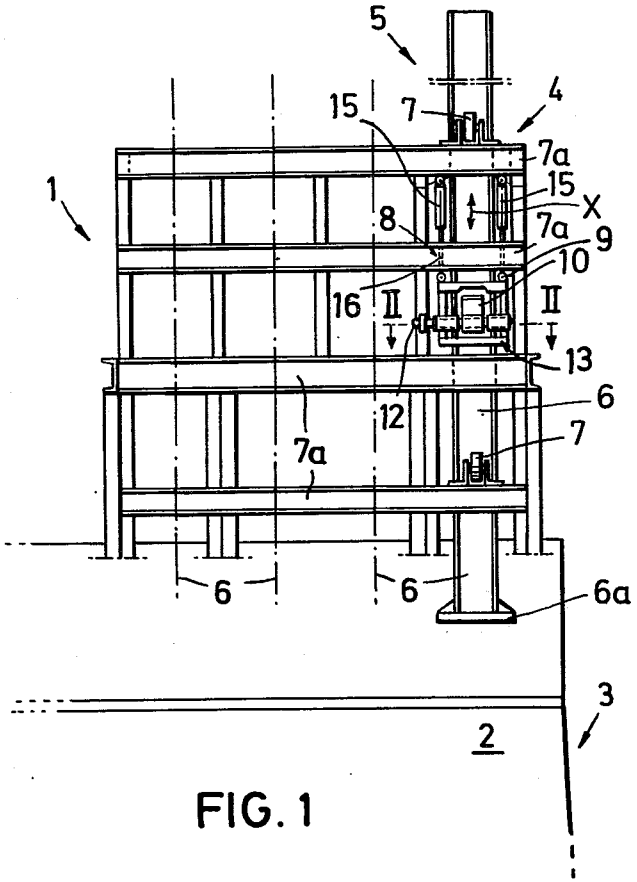
FIG. 1 is a somewhat diagrammatic side view of an apparatus according to the invention.
Figure 3:
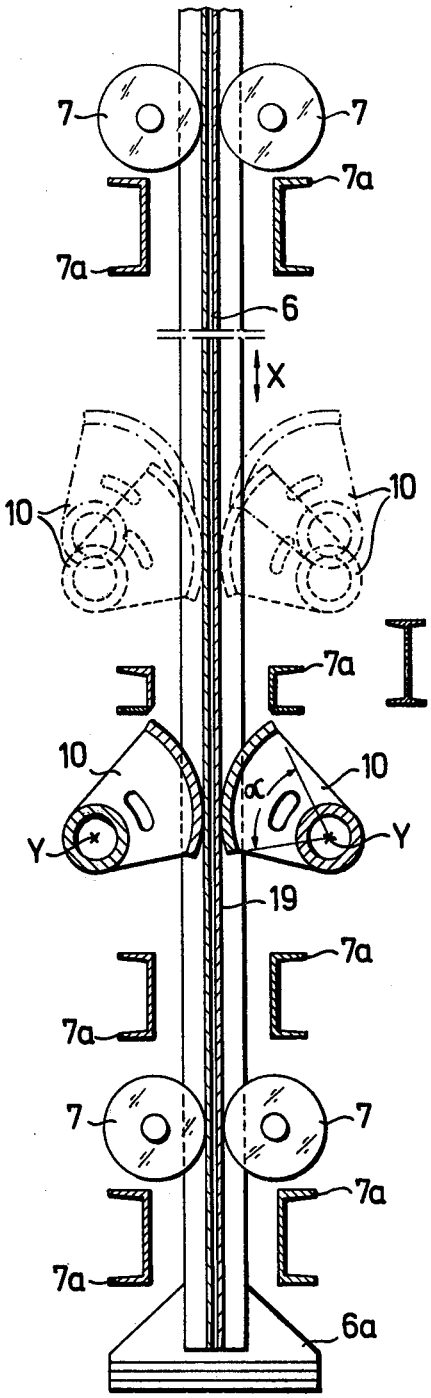
FIG. 3 is a section taken on line III—III of FIG. 2.

According to the invention each punner 5 has associated with it an arrangement for raising the punner — and for maintaining it in the raised position when desired, namely when the cake is to be removed and a new coal charge to be supplied. FIG. 1 shows only a single punner 5 with the associated arrangement 8 since this is representative of all punners.

The arrangement 8 comprises two engaging elements 10 which are mounted in a lifting unit 9 at opposite sides of the upright of the punner 5. Unit 9 affords the elements 10 a movement in direction of the double-headed arrow X, i.e., in the direction of movement of the punner. A pair of shafts 12 are journalled at opposite sides of the punner 5 in a circumferentially complete frame 13, and the elements 10 are mounted on the respective shafts 12 oppositely one another. Also mounted on the shafts, again oppositely one another so as to be in meshing engagement, are respective gear segments 11. Shafts 12 are located in a common horizontal plane and extend parallel to each other.

The webs of the H-cross-section uprights on the punner are provided with friction material 19 (e.g., rubber layers), at least where they are engaged by the engaging surfaces 14 of the elements 10.

The elements 10 are mounted on the respective shafts 12 with freedom of relative angular displacement, i.e., shafts 12 have limited freedom of turning relative to elements 10. This is shown in the drawing, especially in FIG. 2 which also shows that the surfaces 14 extend eccentrically with reference to the pivot axes Y of the elements 10. The ends of the surfaces 14 include with the respective pivot axis Y an angle $\alpha$ which is smaller than 90°, preferably about 60°. Since this construction assures that the center of gravity of the elements 10 is transversely spaced from the pivot axes Y, it will be appreciated that the elements 10 engage the punner 5 solely as a function of their own weight, i.e., under the influence of gravity.

Figure 4:
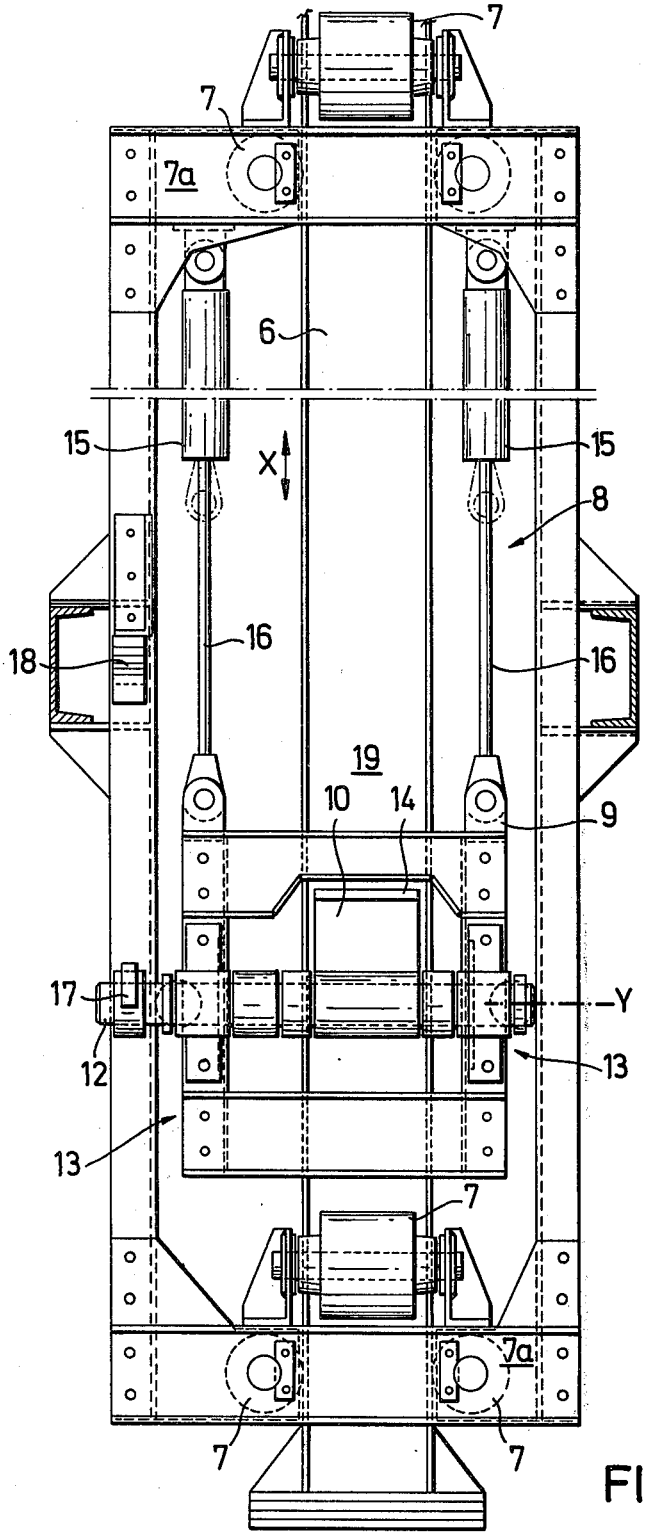
FIG. 4 is a section taken on line IV—IV.
Figure 5:
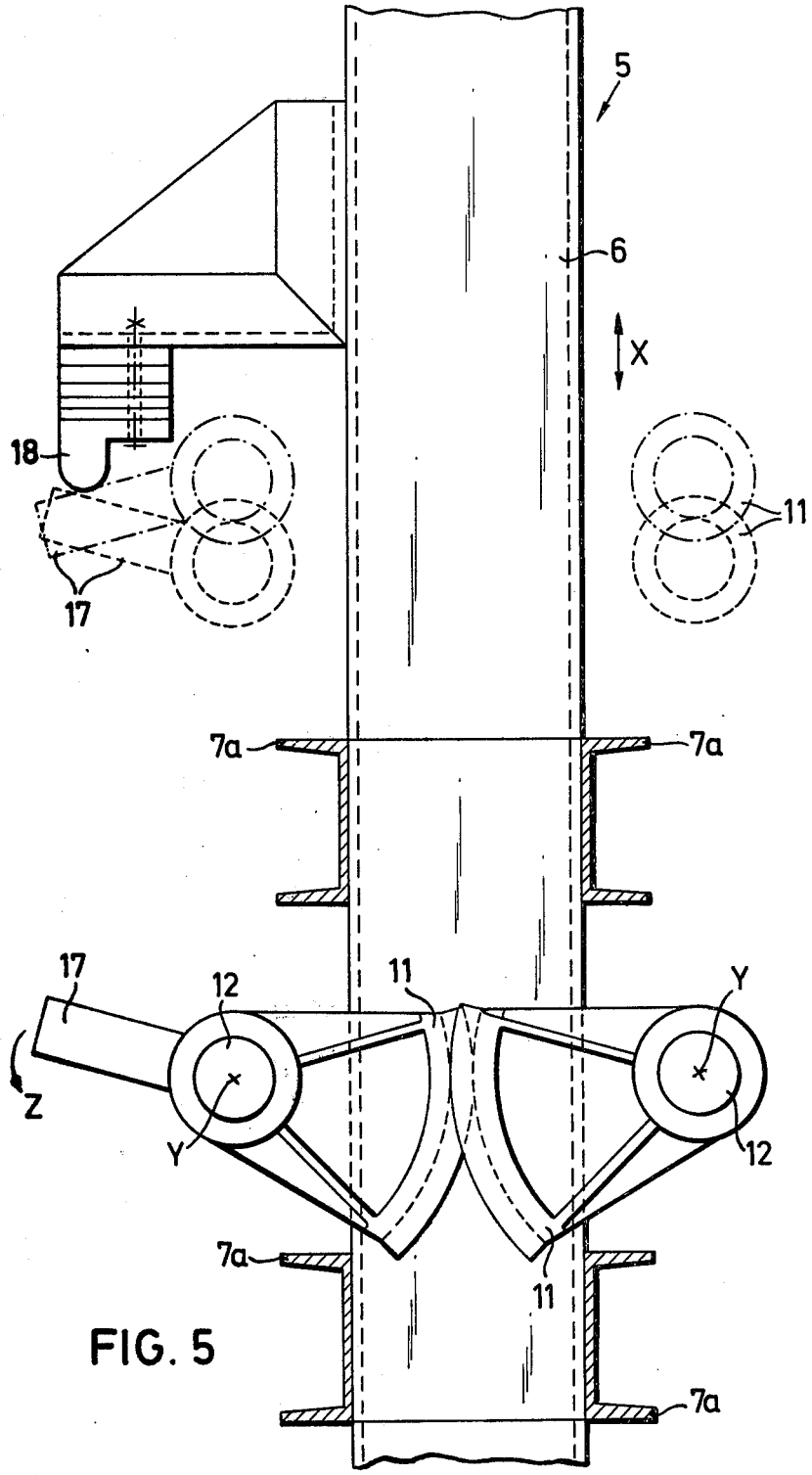
FIG. 5 is a section on line V—V of FIG. 2.

The unit 9 is shown in detail in FIG. 4 where it will be seen to be provided at the opposite sides of the upright of punner 5 with respective hydraulic cylinder-and-piston units 15. The cylinders of these units are connected to an upper one of the beams 7*a*, whereas the piston rods 16 extend in the direction X towards the pounding box 2, their free ends being connected to the frame 13. In operation the pistons and piston rods 16 of both units 15 are alternately extended and retracted in unison, so that the elements 10 — which are secured to the piston rods 16 via the unit 9 and frame 13 — are alternately raised and lowered. Since the elements 10 pivotally engage the punner 5 solely under the influence of gravity, the punner 5 is clampingly gripped by the elements 10 when the same begin to move from their lower position towards their upper position and is raised during the upward retraction of the piston rods 16.

Once the punner 5 and the elements 10 have reached their upper position, the elements 10 automatically release the punner so that it drops, descending from a higher position to a lower position through the loss or lack of support and solely by gravity onto the coal 2. For this purpose an arm 17 is non-rotatably secured (e.g., bolted) to one of the shafts 12; when this shaft turns the arm 17 can pivot vertically in downward direction (arrow Z). When the punner is in its upper position the arm 17 cooperates with a stationary abutment 18 of the apparatus 1, in such a manner that the shaft 12 on which arm 17 is mounted is rotated — this movement is transmitted to the other shaft 12 and thus both elements 10 are disengaged from punner 5. The elements 10 and gear segments 11 are shown in broken lines (FIGS. 3, 5) in their upper positions just before they release the punner 5, and in claim lines just after they have released it. Upon dropping of the punner 5 onto the coal 2, the piston rods 16 are downwardly extended again to start a new punner-raising cycle.

The alternate raising and dropping of the punners 5 continues until the coal 2 has been pounded sufficiently to become converted into a cake. The punners 5 are then retained in their upper position the next time they are raised up to the same, so that the cake can be removed. For this purpose it is merely necessary to retract the piston rods 16 upwardly only to such an extent that the arm 17 does not engage the abutment 18, whereby disengagement of the elements 10 from punner 5 is avoided so that they keep the punner in the upper position as long as desired.

The apparatus according to the invention is relatively simple in its construction and, therefore, inexpensive to build. It is much quieter than the prior art because it has no noisy rotating parts. Since the elements 10 engage the punner only in a clamping relationship and solely due to gravity, wear of these elements and of the punner itself is reduced to a minimum. Moreover, the height to which the punner is lifted will always be the same during each raising operation.

A single element 10 could be used for each punner, but the clamping effectiveness is better if two are used. The cross-section of the punner upright need not be H-shaped. If desired, a separate drive could be provided for pivoting the elements 10 into and out of engagement with the punner, but the illustrated embodiment is of course much simpler.

While the invention has been illustrated and described as embodied in an apparatus for compacting coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an apparatus for compacting coal in a pounding box to convert the coal into a cake usable in coke ovens by repeatedly lifting and dropping onto the coal at least one vertically displaceable punner composed of an upright and a foot at a lower end of the same, a combination comprising engaging means for frictionally engaging said upright; mounting means mounting said engaging means for displacement in a path between a lower position in which it engages and entrains said upright and an upper position in which it releases said upright and permits the punner to gravitationally descend onto the coal; and drive means for moving said engaging means between said positions thereof.

2. A combination as defined in claim 1, wherein said mounting means comprises a horizontal shaft, and said engaging means comprises an engaging member mounted on said shaft and pivotable into and out of engagement with said upright.

3. A combination as defined in claim 1, wherein said engaging means comprises two engaging elements located at a common level but at opposite sides of said upright and each engageable with one of said opposite sides thereof.

4. A combination as defined in claim 3, said engaging means further comprising a common frame at least in part embracing said engaging elements.

5. A combination as defined in claim 3, wherein said upright is of substantially H-shaped cross-section and has two parallel webs, said engaging elements each engaging one of said webs.

6. A combination as defined in claim 3, wherein each of said engaging elements is mounted for pivotal movement about a pivot axis and has an engaging face which is eccentric with reference to said pivot axis.

7. A combination as defined in claim 6, wherein said engaging face of each engaging element extends substantially circumferentially of the respective pivot axis and has circumferentially spaced ends which include with said pivot axis an angle smaller than 90°.

8. A combination as defined in claim 1, wherein said engaging means comprises two engaging elements located at a common level but at opposite sides of said upright, said engaging elements being simultaneously engageable with and subsequently simultaneously disengageable from the respective opposite sides of said upright.

9. A combination as defined in claim 8, wherein said mounting means comprises a pair of horizontal shafts located at said opposite sides and each mounting one of said engaging elements for pivotal movement between said positions.

10. A combination as defined in claim 9, wherein said drive means comprises a gear segment mounted on each of said shafts, said shafts being located in parallel in a common horizontal plane and the teeth of said gear segments inter-engaging with one another.

11. A combination as defined in claim 9, wherein each of said engaging elements is journalled on the associated shaft with freedom of limited angular displacement relative thereto and engages said upright under the influence of gravity.

12. A combination as defined in claim 11; and further comprising means for disengaging said engaging elements from said upright in said upper position.

13. A combination as defined in claim 12, wherein said disengaging means comprises a stationary abutment and an arm on one of said shafts which engages said abutment when said upright is in an upper position thereof, so as to rotate said arm and shaft in a sense causing said engaging elements to release said upright.

14. A combination as defined in claim 1; and further comprising friction means on said upright for contact with said engaging means.

15. A combination as defined in claim 1, said drive means comprising a unit mounting said engaging means for substantially vertical displacement.

16. A combination as defined in claim 15, said unit comprising a cylinder-and-piston element having a piston rod which is coupled to said engaging means.

17. A combination as defined in claim 16, said cylinder-and-piston element having an upright orientation and said piston rod having a free end portion which extends towards the pounding box.

18. A combination as defined in claim 15, said engaging means comprising two engaging elements at opposite sides of said upright; and said unit comprising at each of said sides a cylinder-and-piston element having respective pistons which are movable in unison.

19. A combination as defined in claim 18, wherein said elements are hydraulic cylinder-and-piston elements.

20. A combination as defined in claim 3, wherein the punner descends solely due to the power of gravity after said mounting means releases said upright.

* * * * *